US006032654A

United States Patent [19]

Kato

[11] Patent Number: 6,032,654

[45] Date of Patent: Mar. 7, 2000

[54] FUEL SUPPLY FOR INJECTED MARINE ENGINE

[75] Inventor: Masahiko Kato, Hamamatsu, Japan

[73] Assignee: Sanshin Kogyo Kabushiki Kaisha, Hamamatsu, Japan

[21] Appl. No.: 09/095,405

[22] Filed: Jun. 10, 1998

[30] Foreign Application Priority Data

Jun. 10, 1997 [JP] Japan ..... 9-152630

[51] Int. Cl.[7] ..... F02M 37/04

[52] U.S. Cl. ..... 123/509; 123/495

[58] Field of Search ..... 123/509, 514, 123/516, 495, 518

[56] References Cited

U.S. PATENT DOCUMENTS

| | | | |
|---|---|---|---|
| 4,811,717 | 3/1989 | Nakahama | 123/509 |
| 5,239,967 | 8/1993 | Adam | 123/509 |
| 5,259,352 | 11/1993 | Gerharoy | 123/509 |
| 5,309,885 | 5/1994 | Rawlings | 123/516 |
| 5,355,859 | 10/1994 | Weber | 123/497 |
| 5,404,858 | 4/1995 | Kato | 123/516 |
| 5,450,831 | 9/1995 | Furuoka | 123/509 |
| 5,669,358 | 9/1997 | Osakabe | 123/509 |

*Primary Examiner*—Carl S. Miller
*Attorney, Agent, or Firm*—Knobbe, Martens, Olson & Bear LLP

[57] ABSTRACT

A fuel supply system for an internal combustion engine mounted in a cowling of a marine device is disclosed. The engine has a body defining at least one combustion chamber and an output shaft arranged to drive a water propulsion device of the marine device. The engine has an intake system supplying air to the combustion chamber. The fuel supply system includes at least one fuel injector providing fuel to the engine for combustion with the air. Various configurations for at least two pumps used to deliver fuel from a fuel source to the fuel injector(s) which contribute to reduced vapor production and improved pumping efficiency are disclosed.

17 Claims, 6 Drawing Sheets

FUEL SUPPLY FOR INJECTED MARINE ENGINE

FIELD OF THE INVENTION

The present invention relates to an engine used in a marine application, such as for powering a propeller of an outboard motor. More particularly, the invention is a fuel supply system for such an engine which is fuel injected.

BACKGROUND OF THE INVENTION

Watercraft are often powered by an outboard motor positioned at their stern. The outboard motor has an internal combustion engine positioned within a cowling, the engine arranged to power a water propulsion device of the motor.

The motor is normally mounted to the watercraft to permit the motor to be moved independent of the watercraft in both the horizontal and vertical directions. To promote easy movement of the motor and so that the motor does not contribute to significant air drag, the motor is generally designed to be extremely compact.

In order for the motor to be compact, its cowling must be small, reducing the internal engine space. The components of the engine are thus placed very close together, and the space between the engine and the cowling is minimal. So arranged, the substantial heat generated by the engine is to a large degree trapped in the cowling and transmitted to the engine components.

In order to improve emission quality and fuel economy, fuel may be supplied to the engine powering an outboard motor with one or more fuel injectors. The fuel supply system for such an engine is generally arranged so that fuel is supplied from a supply under high pressure to the injector.

When this type of fuel injected engine is used to power an outboard motor, several problems result. First, the high temperatures in the cowling exacerbate vapor creation in the fuel system. Vapor in the fuel reduces the effectiveness or efficiency of the pump which is used to pressurize the fuel to a high pressure. When either the pressure or volume of fuel supplied is reduced, the efficiency of the fuel injection system is compromised.

In addition, difficulties arise in using a single pump for moving the fuel from the supply to the injector(s) and for pressurizing the fuel. This single pump must be excessively large or be arranged to sacrifice delivery capacity in favor of providing fuel under high pressure.

It is, therefore, an object of the present invention to provide an improved fuel supply for an engine of the type used in a marine application.

SUMMARY OF THE INVENTION

In accordance with the present invention, there is provided a fuel supply for an internal combustion engine mounted in a cowling of a marine device.

The engine is preferably of the type having a body which defines at least one combustion chamber and an output shaft arranged to drive a water propulsion device of the marine device. The engine has an intake system supplying air to the combustion chamber.

The fuel supply system includes at least one fuel injector for delivering fuel to the engine for combustion in the combustion chamber with the air. At least a first pump and a second pump positioned in the cowling are arranged to deliver fuel from a fuel source to the at least one fuel injector, the first and second pumps each having an inlet. A main fuel line leads from a fuel source to a branch line extending to the inlet of each of the first and second pumps.

In a first embodiment, the first pump is positioned vertically higher than the second pump, the inlet of the second pump being positioned vertically lower than a point at which the branch lines extend from the main fuel line.

In another embodiment, the fuel system includes a third pump and a connecting passage leading from an outlet of either the first or second pump to an inlet of the third pump.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is a fuel supply system. The fuel supply system of this invention is particularly suited to use with an engine used in a marine application, such as one which powers a water propulsion device of an outboard motor propelling a watercraft. Those of skill in the art will appreciate, however, that the fuel supply system may be used with an engine utilized in any of a wide range of other applications.

Figure 1:
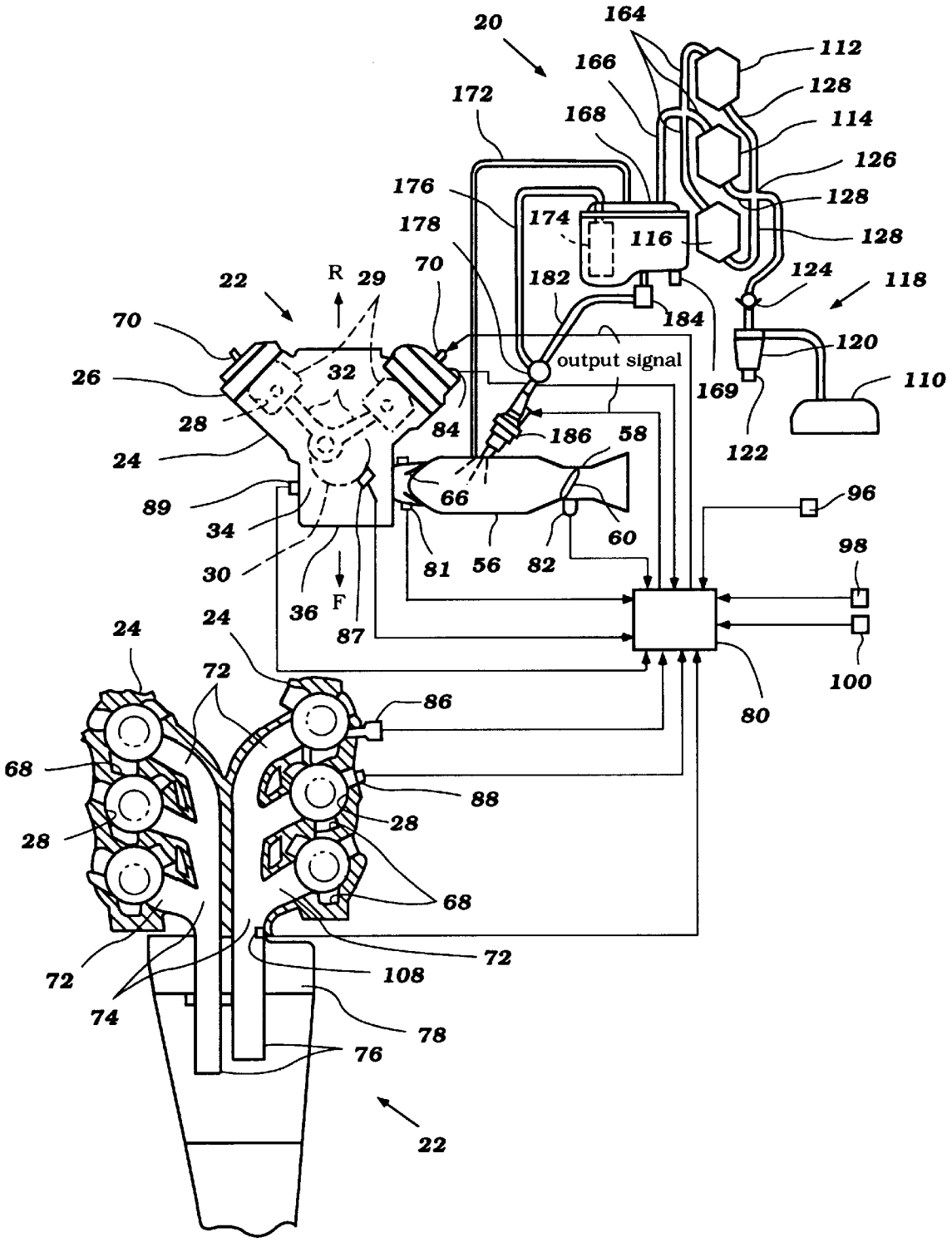
FIG. 1 illustrates in schematic fashion a fuel supply system for an engine in accordance with a first embodiment of the present invention, the engine including a control unit and illustrated both in plan end view and in cross-section.
Figure 3:
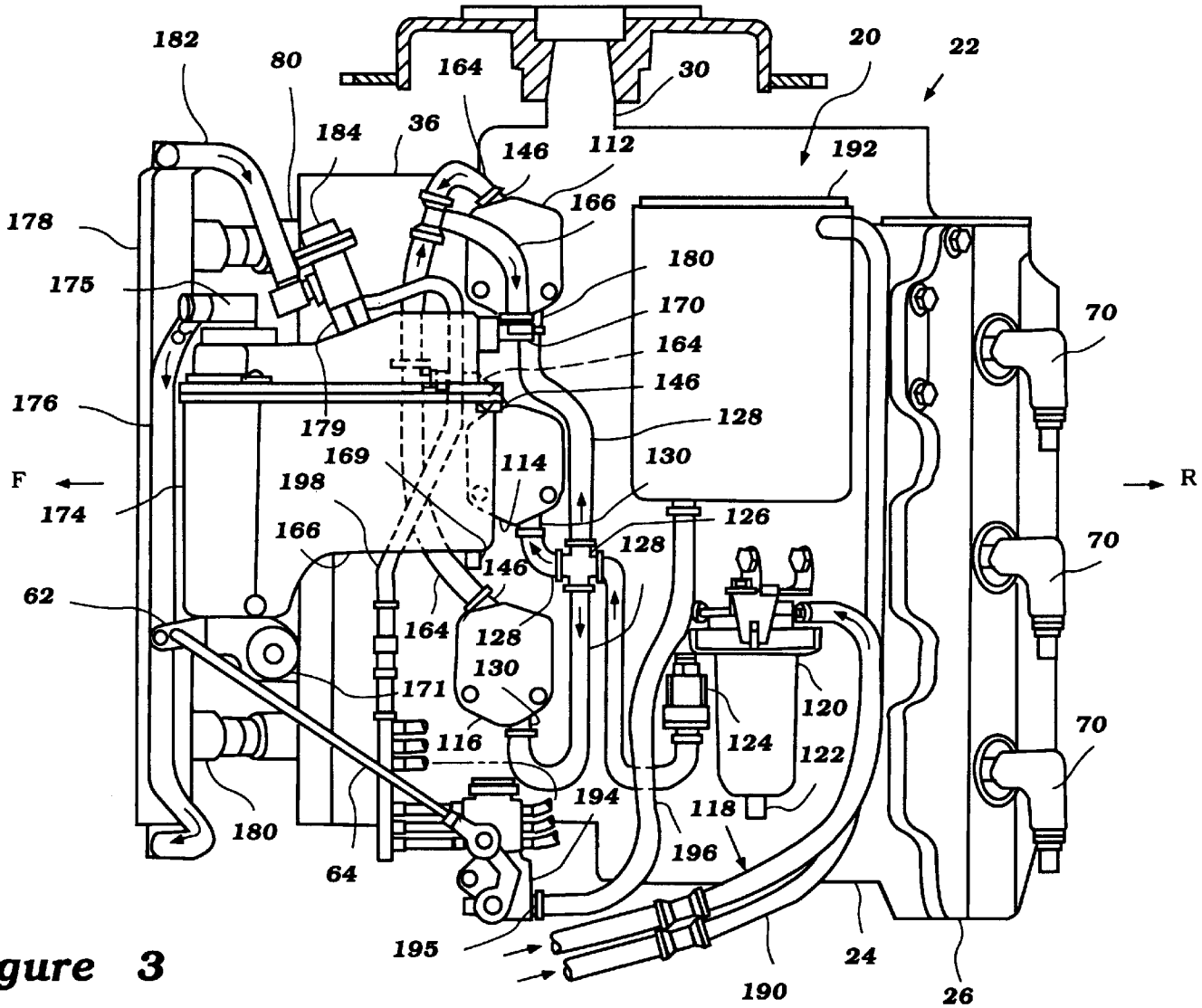
FIG. 3 is a partial side view of the engine having the fuel system illustrated in FIG. 2, with the cowling of the outboard motor removed.

Referring to FIGS. 1 and 3, a first embodiment fuel supply system 20 in accordance with the present invention is shown as adapted for use with an internal combustion engine 22 operating on a two-cycle principal. The engine 22 illustrated is of the "V" type. This engine 22 has a body comprising a cylinder block 24 having a pair of cylinder heads 26 connected thereto. The cylinder block and heads 24,26 define a pair of cylinder banks. The cylinder block and head 24,26 comprising each bank defines three cylinders 28 therein.

A piston 29 is movably mounted within each cylinder 28 and cooperates with the cylinder block 24 and its respective head 26 to define a combustion chamber. Each piston 29 is connected to a crankshaft 30 with a connecting rod 32. The crankshaft 30 is mounted for rotation with respect to the cylinder block 24 in a crankcase chamber 34. The crankcase chamber 34 is positioned opposite the cylinder heads 26 and defined by a crankcase cover 36 attached to the cylinder block 24.

It should be understood that the engine 22 may be configured in many other ways than that described above. For example, the engine 22 may have as few as one cylinder per bank, or more than three. In addition, the engine 22 may be arranged in other than "V" fashion.

Figure 2:
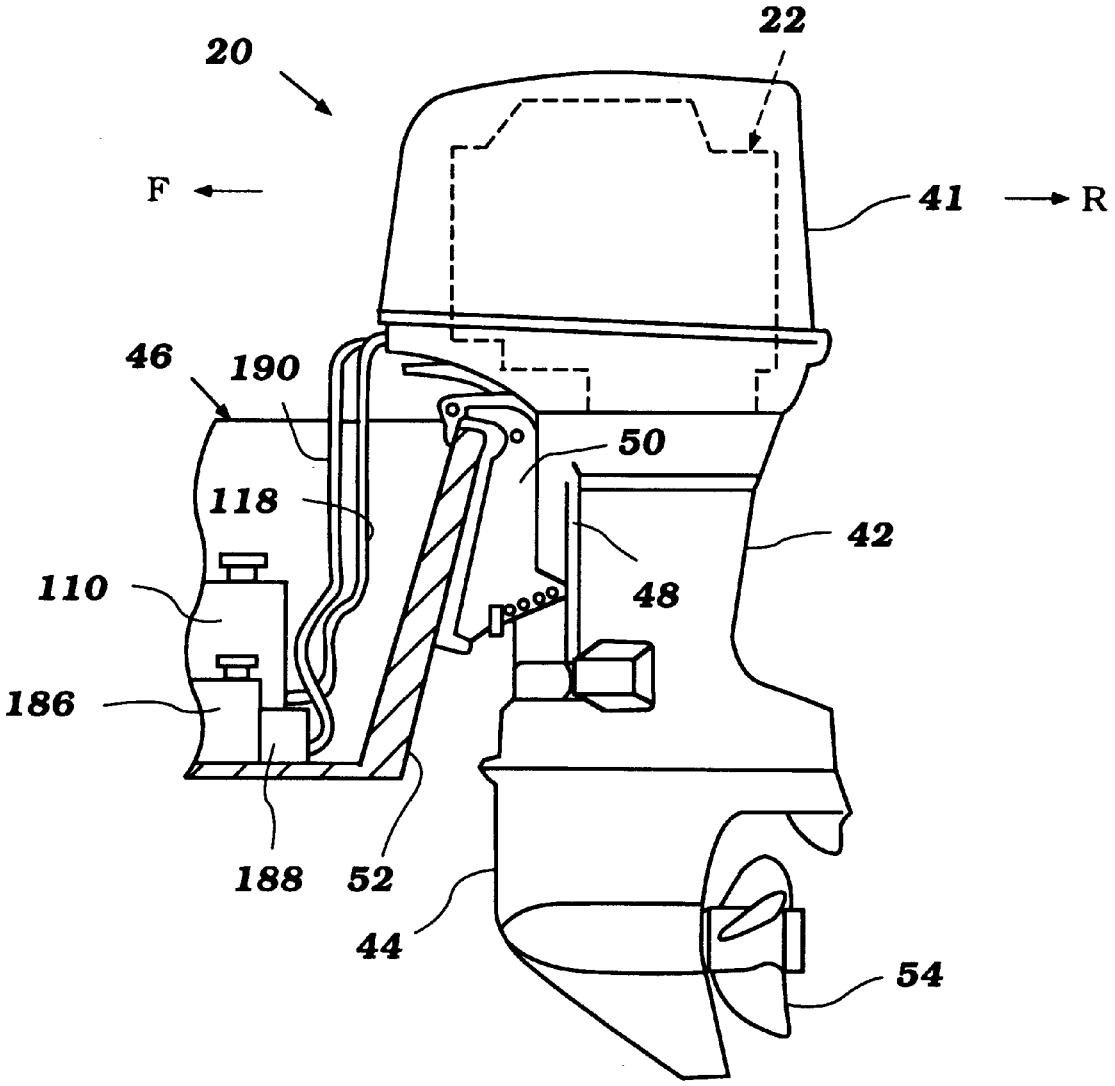
FIG. 2 is a side view of an outboard motor powered by the engine having the fuel system illustrated in FIG. 1, the motor connected to a watercraft having a hull illustrated in cross-section.

The engine 22 is preferably utilized in a marine application. As illustrated in FIG. 2, the engine 22 is used to power a water propulsion device of an outboard motor 40.

The motor 40 preferably includes a main cowling 41 in which the engine 22 is positioned, and a lower unit extending below the cowling 41. As illustrated, the lower unit comprises an upper or drive shaft housing 42 and a lower portion 44.

The motor 40 is preferably movably mounted to a watercraft 46. The motor 40 is rotatably mounted for steering movement about a vertical axis by a steering shaft (not shown) positioned in a swivel arm 48. The swivel bracket 48 is, in turn, rotatably mounted to a mounting bracket 50 about a horizontal axis.

The mounting bracket 50 is connected to the hull 52 of the watercraft 46, preferably at a transom portion thereof. Though not illustrated, the crankshaft 36 of the engine 22 is arranged to drive a water propulsion device associated with the motor 40, in this case a propeller 54. In this arrangement, the engine 22 is positioned in the main cowling 41 so that the crankshaft 30 is generally vertically extending. The crankcase end of the engine 22 faces towards a front end F of the motor 40, while the end of the cylinder block 24 to which the cylinder heads 26 are mounted faces the rear end R of the motor 40.

Referring still to FIG. 2, an intake system is provided for supplying each cylinder 28 of the engine 22 with an air and fuel mixture for combustion. In this embodiment, an intake passage 56 leads through a throttle body 58 to the crankcase chamber 34 of the engine 22. The intake passage 56 has one end which is open and through which air is drawn. Preferably, the open end of the passage 56 is positioned in an air box (not shown), through which air is drawn from within the cowling 41.

A throttle valve 60 is provided in the intake passage 56 for controlling the flow rate of air therethrough. The throttle valve 60 preferably comprises a butterfly type plate movably mounted in the intake-passage 56, and remotely operable by the operator of the watercraft by a throttle control which includes a throttle lever 62 connected to a link rod 64 (see FIG. 3).

As described in detail below, a fuel supply system provides fuel to the engine 22 for combustion with the air. In the preferred arrangement, the fuel is supplied to the air passing through the intake passage 56.

The air and fuel mixture passes through a reed valve 66 and into a portion of the crankcase chamber corresponding to one of the cylinders. As is well known, the crankcase chamber 34 is divided into individual chambers, one corresponding to each of the six cylinders 28.

The air and fuel charge is compressed in each individual crankcase chamber and then drawn through a scavenge passage 68 into its corresponding cylinder, where it is ignited with a spark plug 70 or similar device. Upon ignition, the piston 29 is forced downwardly and effectuates a rotation of the crankshaft 30.

Exhaust gasses from the combustion process are routed from each cylinder through an exhaust passage 72. Each exhaust passage 72 corresponding to the cylinders 28 in each bank lead to a common exhaust collection passage 74. These common exhaust collection passages 74 extend towards a bottom end of the engine 22.

As is common in outboard motor 40 practice, the engine 22 is positioned above an exhaust guide 78. Each of the two common passages 74 extend to a corresponding passage through the exhaust guide 78, and thereon to an exhaust pipe 76 extending into a chamber or muffler in the lower unit of the motor 40. The exhaust is then discharged through a below water hub discharge or an above the water or similar discharge, as is well known in the art.

Although not illustrated, a cooling system is preferably provided for cooling the engine 22. In the situation where the engine 22 powers an outboard motor, the cooling system preferably draws water from the body of water in which the motor is operating and delivers it through one or more coolant passages through the engine 22, such as coolant jackets corresponding to the cylinders, and then expels the coolant back to the body of water. In this arrangement, the water is preferably pumped by a pump driven off of the a drive shaft which is driven by the crankshaft 30 of the engine 22 and which also drives the water propulsion device of the motor.

An engine control is preferably provided for controlling one or more aspects of the engine 22. Preferably, this engine control includes an electronic engine control unit or ECU 80. This ECU 80 preferably includes a memory or map of engine control strategies, which, when appropriate engine condition data is supplied thereto, generates instructions for controlling the engine 22.

A variety of data is supplied to the ECU 80 by one or more sensors. As illustrated in FIG. 1, a temperature sensor 81 is preferably provided along the intake passage 48 for providing data regarding the temperature of the incoming air. A throttle opening sensor 82 provides data regarding the position of the throttle valve 60 as controlled by the operator.

A pressure sensor 84 mounted in one of the cylinders provides data regarding the pressure inside the cylinder of the engine 22. An oxygen sensor 86 is positioned to monitor the oxygen content of the exhaust and provides this data to the ECU 80. A temperature sensor 88 provides data regarding the temperature of the engine 22. A crank angle sensor 87 provided data regarding the position of the crankshaft 30, and thus the pistons 28. A crankcase pressure sensor 89 provides data regarding the pressure of the air and fuel charge within at least one of the crankcase chambers of the engine 20.

Data such as the atmospheric air pressure 96, incoming coolant temperature 98 and engine knock 100 (i.e. in-cylinder precombustion of the air/fuel mixture) are also provided to the ECU 80. A back pressure sensor 108 is preferably positioned along at least one of the common or collection exhaust passages 74. This sensor 108 provides the ECU 80 with data regarding the actual pressure of the exhaust within the exhaust system.

The ECU 80 is arranged to control a number of engine functions, such as the firing timing of the spark plugs 70 and the activation of fuel injectors (described in detail below) for controlling the air/fuel ratio.

In accordance with the present invention, a fuel supply system 20 provides fuel into the air passing through the intake passage 48. The fuel supply system 20 is arranged to deliver fuel from a fuel source to the engine 22.

Referring to FIG. 2, the fuel source may comprise a fuel tank 110 mounted in the watercraft 46. Means are provided for drawing fuel from this tank 110 or other source. Referring to FIGS. 1 and 3, this means comprises three low-pressure diaphragm type pumps 112,114,116.

The pumps 112,114,116 draw fuel through a main fuel line 118. A filter 120, such as a water-separating filter, is positioned along this line 118. A fuel pressure sensor 122 is preferably positioned at the filter 120 for sensing the fuel pressure along the line 118.

The fuel flows from the filter 120 through a one-way check valve 124 positioned along the line 118. This valve 124 is arranged to prevent the reverse flow of fuel towards the fuel tank 110.

As illustrated, the main fuel line 118 leads to a cross-fitting 126 to which is connected a branch supply pipe 128 leading to each pump 112,114,116. Each branch supply pipe 128 leads to an intake port 130 associated with its respective pump 112,114,116.

Figure 4:
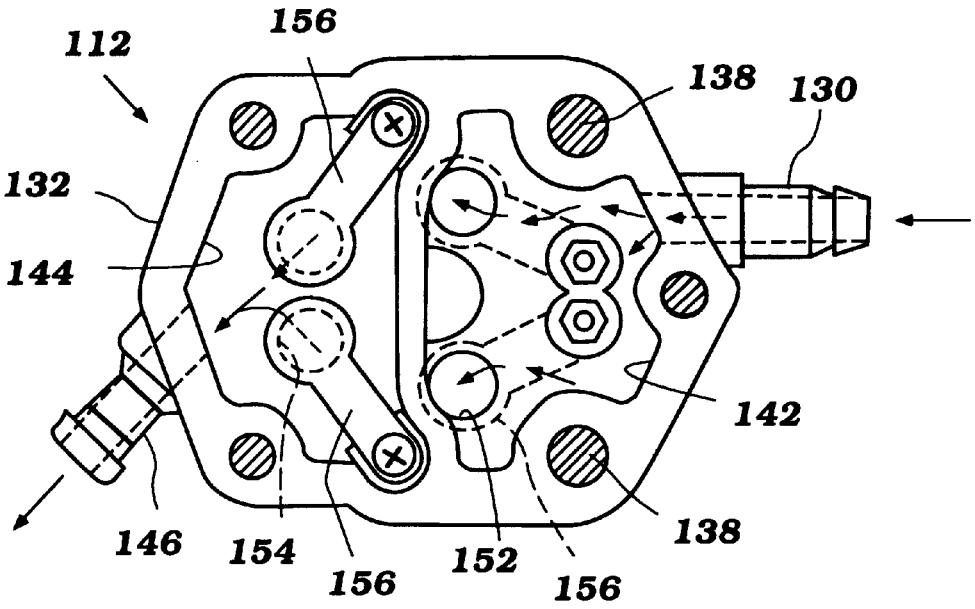
FIG. 4 is a top view of a low pressure fuel pump of the fuel system illustrated in FIG. 1, with a cover of the pump removed.
Figure 5:
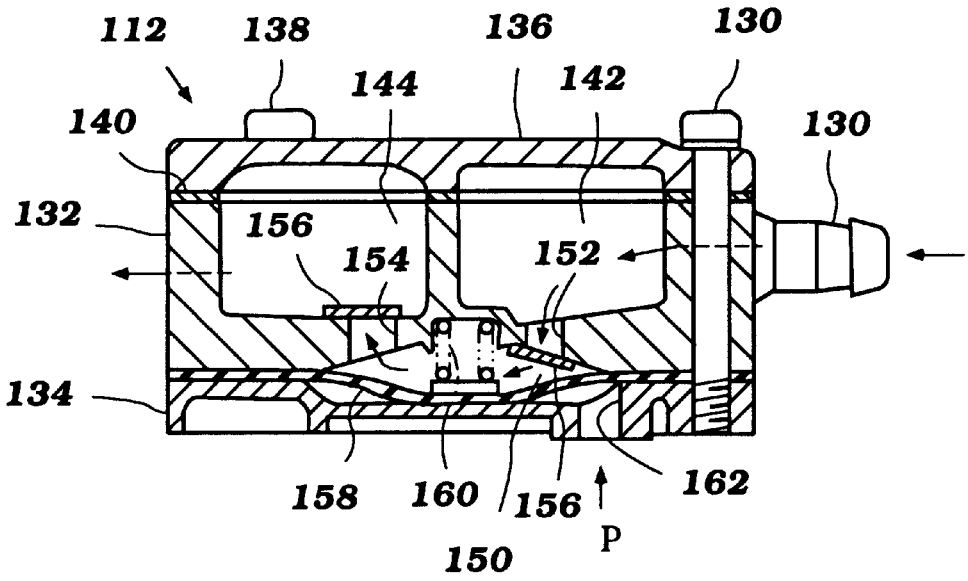
FIG. 5 is a cross-sectional side view of the fuel pump illustrated in FIG. 4.

The construction of the pumps 112,114,116 will be described in detail with reference to FIGS. 4 and 5. In these figures, a single of the pumps 112 is illustrated, its being understood that the other pumps 114,116 are identical in construction.

The pump 112 has a central body 132 to which is connected a base 134 and a lid 136, the lid 136 being positioned on an opposing surface of the body 132 from the base 134. As illustrated, a number of threaded fasteners 138 are used to securely connect the base 134, body 132 and lid 136. A seal 140 is positioned between the lid 136 and body 132.

The lid 136 and body 132 cooperate to define an intake chamber 142 and an outlet chamber 144. The intake chamber 142 is in communication with the intake port 130 by a passage through the wall of the body 132. The outlet chamber 144 is in communication with an outlet port 146 via a similar passage. As may now be appreciated, the seal 140 between the lid 136 and body 132 prevents the passage of material from exterior of the pump 112 into these chambers 142,144 (such as air), or from the chambers 142,144 to the exterior of the pump 112 (i.e. fuel leaks).

The base 134 and body 132 cooperate to define a pumping chamber 150. A first pair of connecting passages 152 lead from the intake chamber 142 to the pumping chamber 150. A second pair of connecting passages 154 lead form the pumping chamber 150 to the outlet chamber 144. Valve means are provided for selectively opening and closing these connecting passages 152,154. As illustrated, the valve means comprises a plate-type check valve 156 associated with each of these passages 152,154.

Means are provided for pumping fuel from the intake chamber 142 to the outlet chamber 144 via the pumping chamber 150. Preferably, this means comprises an air pressure activated diaphragm 158. The diaphragm 158 has at least one portion positioned in the pumping chamber 150 and is movable between first and second positions. The diaphragm 158 divides the pumping chamber 150 into a first "fuel" area which is in communication with the connecting passages 152,154, and an opposing second "air" area.

Means are provided for biasing the diaphragm 158 into a first position in which the volume of first area of the pumping chamber 150 is relatively large. As illustrated, this means comprises a coil spring 160. Means are also provided for moving the diaphragm 158 into a second position in which the volume of the first area of the pumping chamber 150 is reduced as compared to when the diaphragm is in its first position. Preferably, this means comprises a high pressure air source.

As illustrated, a connecting passage 162 leads through the base 134 to the second area of the pumping chamber 150. This passage 162 is in communication with the crankcase chamber 34, such as by a line or hose.

The operation of the pump 112 is as follows. Fuel in the intake chamber 142 flows through the first pair of connecting passages 152 into the first area of the pumping chamber 150 when the check valves 156 opens as the diaphragm 158 moves downwardly under the force of the spring 160. As the pressure P in the crankcase chamber 34 increases, the air pressure is transmitted to the diaphragm 158 through the passage 162.

This high pressure air forces the diaphragm 158 upwardly into its second position in which the volume of the first area of the pumping chamber 150 is reduced. At this time, the check valves 156 associated with the first pair of connecting passages 152 are arranged to prevent the reverse flow of fuel towards the intake chamber 142. On the other hand, the check valves 156 associated with the second pair of connecting passages 154 open. This permits fuel to flow into the outlet chamber 144 and thereon through the outlet port 146.

As the pressure in the crankcase chamber 34 falls (due to the cyclic movement of the pistons 29), the force of the spring 160 overcomes the air pressure and moves the diaphragm 158 towards its first position in which the volume of the first area of the pumping chamber 150 is increased. At this time, the check valves 156 associated with the second pair of connecting passages 154 close to prevent fuel from being drawn into the pumping chamber 150 from the outlet chamber 144. On the other hand, the check valves 156 associated with the first set of connecting passages 142 open and fuel is drawn from the inlet chamber 142 into the pumping chamber 150.

The process then repeats itself, whereby a continuously pumping action is achieved.

Those of skill in the art will appreciate that pumps which vary from those described may be used in conjunction with the fuel supply system 20.

Referring again to FIGS. 1 and 3, the fuel which is pumped by each pump 112,114,116 through its outlet port 146 flows through a branch outlet hose or line 164. The branch outlet lines 164 corresponding to the three pumps 112,114,116 lead to a single supply line 166 which leads to an inlet 170 of a vapor separator 168.

The vapor separator 168 is arranged to separate fuel vapor from the fuel, and preferably includes a body defining a fuel containing chamber. The body of the separator 168 is mounted to the engine 30 through one or more vibration isolating mounts 171 to reduce shaking of the fuel.

A vapor relief line 172 extends from the chamber of the vapor separator 168 to the engine 22. As illustrated, the line 172 extends to the intake passage 56.

A fuel temperature sensor 169 is preferably associated with the vapor separator 168 for sensing the fuel temperature and outputting this information to the ECU 80. In this arrangement, the ECU 80 obtains information from the temperature sensor 169 and the pressure sensor 122 to sense when excessive vapor is present in the fuel system. In that event, the ECU 80 may be arranged to trigger an alarm, such as a light. In that manner, the operator of the motor 40 is warned and may attempt to avoid vapor lock or similar problems, such as by reducing the speed of the engine 22 in order to lower the temperature of it and the fuel system components. Alternatively, the ECU 80 may be arranged to automatically limit the speed of the engine 22.

The placement of the pressure sensor 122 is also useful in identifying fuel leaks which may occur between the fuel tank 110 and the pumps 112,114,116. If the fuel pressure is low and a high vapor situation is not identified (in that the temperature reading from the temperature sensor 169 is low), the ECU 80 may trigger an alarm warning of a fuel leak.

The fuel from the vapor separator 168 is pressurized to a high pressure by a fuel pump 174. Preferably, this fuel pump 174 is an electrically-powered high pressure pump mounted directly in the vapor separator 168 itself.

Fuel at high pressure is delivered by the pump 174 through an outlet port 175 to a high pressure delivery line 176. This line 176 extends to a fuel rail 178. In the above-described arrangement, an intake passage 56 is preferably provided corresponding to each cylinder 28. As such, a means for providing fuel to the air is provided corresponding to each intake passage 28. This means comprises a fuel injector 180. Each fuel injector 180 is connected to the fuel rail 178 and arranged to deliver fuel therefrom into the air passing through the intake passage 56. In this arrangement there are thus six fuel injectors.

Fuel which is supplied to the fuel injectors 180 but which is not delivered is returned to the vapor separator 168 through a return line 182. The return line 182 extends from an end of the fuel rail 178 opposite that to which the delivery line 176 is connected, and extends to a return port 179 of the separator 178.

A pressure-actuated valve 184 is provided along the return line 182 which permits excess fuel to flow back to the separator 168 but which maintains the pressure of the fuel in the fuel rail 178 at a high pressure.

In accordance with the present invention, the fuel supply system 20 is also arranged to deliver lubricating oil to the engine 22. In general, the fuel supply system 20 is arranged to deliver oil from an oil supply to the engine 22 with the fuel injected by the fuel injectors 178. Those of skill in the art will appreciate that the term "oil" may mean the naturally occurring petroleum mineral, a synthetic lubricant, mixtures thereof or other materials known for use as a lubricant and for reducing corrosion caused by such materials as water.

Referring to FIG. 2, the oil supply comprises a main oil tank 186 positioned in the watercraft 46. A primary oil pump 188, such as an electric pump, delivers oil from the tank 186 through a delivery line 190 to a sub-tank 192. Referring now to FIG. 3, this sub-tank 192 is preferably positioned in the cowling 41 of the outboard motor 40.

Oil is drawn from the sub-tank 192 by a second pump 194 though a supply line 196 which leads from the sub-tank 192 to an inlet 195 of the pump 194. The oil flows from the pump 194 through a primary line 198 to the fuel which is being returned to the vapor separator 168 through the return line 182. The oil and fuel mixture in the separator 168 is then supplied to the engine 22 through the fuel injectors 178.

Of course, the oil could be delivered to the fuel in another location, such as the filter 120 or the like. In addition, the oil could be delivered directly to the engine 22.

In accordance with the fuel supply system 20 of the first embodiment of the invention, the low-pressure fuel pumps 112,114,116 are arranged in the cowling 41 of the motor 40 so that they are positioned vertically higher than one another. As illustrated in FIG. 3, these pumps 112,114,116 are all aligned along a vertical axis.

Importantly, the intake port 130 of the lower-most pump 116 is vertically below or lower than the cross-fitting 126 where the main fuel line branches to the supply branches 128. In this arrangement, the distance from each pump 112,114,116 to the main fuel supply line 118 is nearly equal and the pumps are efficient in pumping large quantities of fuel. In addition, relatively equal pumping is achieved and vapor production is reduced. Because these pumps 112,114, 116 do not contribute to significant vapor production, they may be used in conjunction with the high pressure pump 174 without reducing the efficiency of the high pressure pump 174 which would normally be attributed to the added vapor production associated with more than one pump. Because the high pressure pump 174 does not need to both draw the fuel from the fuel tank 110 and pressurize the fuel, the high pressure pump 174 efficiently pressurizes the fuel.

Figure 6:
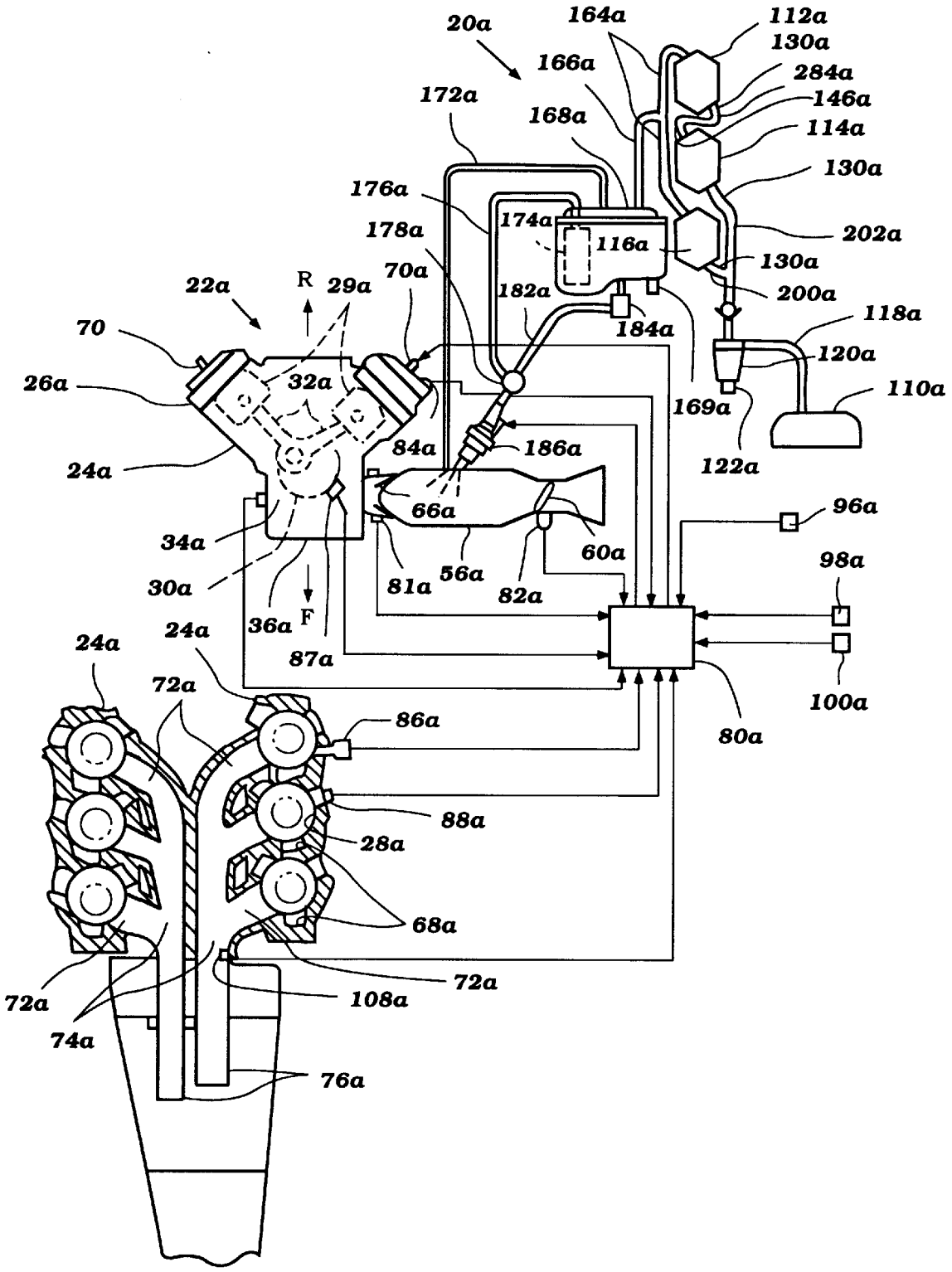
FIG. 6 illustrates in schematic fashion a fuel supply system for an engine in accordance with a second embodiment of the present invention, the engine including a control unit and illustrated both in plan end view and in cross-section.

A fuel supply system 20*a* in accordance with a second embodiment of the present invention will be described with reference to FIG. 6. In the illustration and description of this embodiment, like reference numerals will be used to designate like or similar parts to those used to describe and illustrate the first embodiment, except that an "a" designator has been added to the reference numerals of this embodiment.

In accordance with this embodiment, before the low pressure fuel pumps 112*a,*114*a,*116*a,* the main fuel line 118*a* branches into a first branch pipe 200*a* which extends to a first of the low pressure fuel pumps 116*a,* and a second branch pipe 202*a* which extends to the other two pumps 112*a,*114*a*. The second branch pipe 202*a* leads to the intake port 130*a* of one pump 114*a,* which has its outlet port 146*a* in communication with the intake port 130*a* of the other pump 112*a* via a connecting line 204*a*.

A branch outlet line 164*a* extends from the top and bottom pumps 112*a,* 116*a* to a single supply line 166*a* which leads to a vapor separator 168*a*. In other words, the fuel which passes through the main fuel supply line 118*a* to the first branch pipe 200*a* flows through a single pump 116*a* and thereon to the vapor separator 168*a*. On the other hand, the other fuel flows through one pump 114*a* and then another pump 112*a* before flowing to the vapor separator 168*a*. In the embodiment illustrated where the pumps 112*a,*114*a,* 116*a* are arranged vertically, the highest two pumps 112*a,* 114*a* are thus arranged in series along the fuel path.

In accordance with this embodiment of the invention the lower-most pump 116*a* is efficient as compared to either of the two higher pumps 112*a,*114*a* simply because it does not need to draw the fuel to the same vertical level. In addition, the two highest pumps 112*a,*114*a* cooperate together to efficiently supply fuel to the vapor separator 168*a* notwithstanding that they are likely to draw fuel with a larger content of fuel vapor and have to pump the fuel vertically higher.

Figure 7:
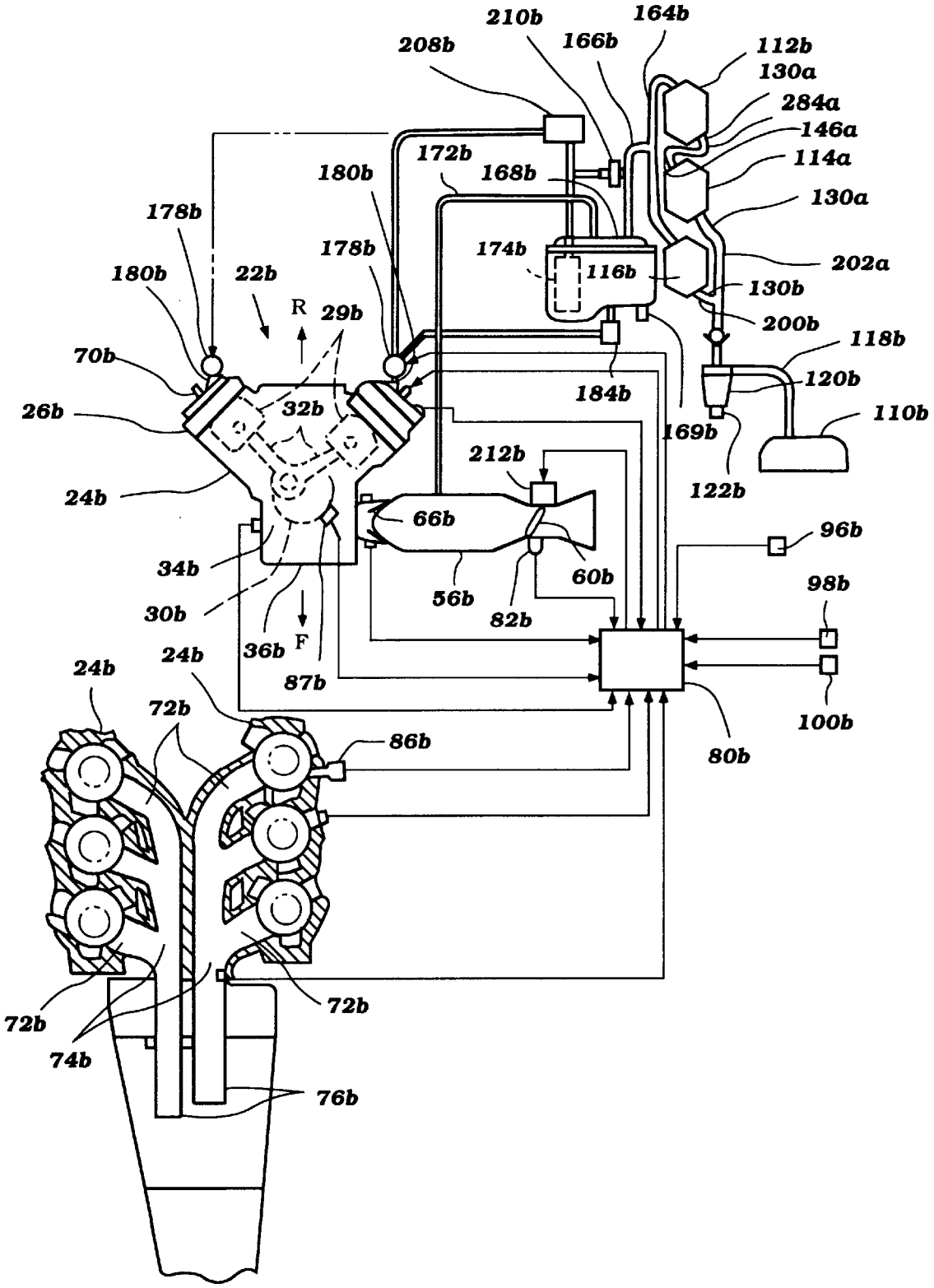
FIG. 7 illustrates in schematic fashion a fuel supply system for an engine in accordance with a third embodiment of the present invention, the engine including a control unit and illustrated both in plan end view and in cross-section.

A fuel supply system 20*a* in accordance with a third embodiment of the present invention will be described with reference to FIG. 7. In the illustration and description of this embodiment, like reference numerals will be used to designate like or similar parts to those used to describe and illustrate the above embodiments, except that a "b" designator has been added to the reference numerals of this embodiment.

In this embodiment, a water or other coolant jacket 206*b* is disposed about at least a portion of the vapor separator

168*b* for cooling the fuel and reducing the vapor level. The cooler fuel is more efficiently pumped by the high pressure fuel pump 174*b*. The water jacket 206*b* is preferably arranged so that coolant flows through the water jacket 206*b*, such as from the cooling system associated with the remainder of the engine 22*b*.

In addition, the high pressure fuel pump 174*b* is arranged to deliver fuel to a second high pressure pump 208*b*, which then delivers the fuel to the fuel injectors 180*b*. In this manner, the fuel pressure may be increased in steps by small high efficiency pumps to the necessary high level.

Excess fuel delivered by the first high pressure pump 174*b* to the second high pressure pump 208*b* which is not delivered thereby is preferably routed back to the supply line 166*b* as regulated by a pressure activated check valve 210*b*.

As illustrated, the fuel system may be arranged so that the second high pressure pump 210*b* delivers fuel to a fuel rail 178*b* corresponding to each cylinder bank, where a fuel injector 180*b* corresponding to each cylinder 28*b* of that bank is arranged to deliver fuel directly into the cylinder.

In this arrangement, the ECU 80 may be arranged to control the position of the throttle valve 60*b* with a throttle actuator 212*b*, as known to those of skill in the art.

Of course, the foregoing description is that of preferred embodiments of the invention, and various changes and modifications may be made without departing from the spirit and scope of the invention, as defined by the appended claims.

What is claimed is:

1. A fuel supply system for an internal combustion engine mounted in a cowling of a marine device, said engine having a body defining at least one combustion chamber and an output shaft arranged to drive a water propulsion device of said marine device, said engine having an intake system supplying air to said combustion chamber, said fuel supply system including at least one fuel injector for delivering fuel to said engine for combustion in said combustion chamber with said air, at least a first pump, a second pump and a third pump positioned in said cowling, said pumps being vertically spaced, one above another and arranged to deliver fuel from a fuel source to said at least one fuel injector, said pumps each having an inlet at one side thereof and an outlet at another side thereof, a main fuel line leading from said fuel source to a respective branch line extending to said inlet of a respective one of at least two of said, said inlet of at least one of said pumps being positioned vertically lower than a point at which said branch lines extend from said main fuel line, a single supply line, and a plurality of branch supplies, each extending from at least two of said pump outlets to a common connection to said single supply line at a point vertically disposed between the outlets of the lowermost and uppermost pumps.

2. The fuel supply system in accordance with claim 1, wherein said pumps comprise diaphragm-type low pressure pumps.

3. The fuel supply system in accordance with claim 1, wherein the single supply line delivers fuel to a high pressure pump, said high pressure pump providing fuel at high pressure to said at least one fuel injector.

4. The fuel supply system in accordance with claim 3, wherein said fuel is delivered from said single supply line to a vapor separator, said high pressure pump arranged to draw fuel from said vapor separator.

5. The fuel supply system in accordance with claim 1, wherein a fuel pressure sensor is provided along said main fuel line between said fuel source and said branch lines.

6. A fuel supply system for an internal combustion engine mounted in a cowling of a marine device, said engine having a body defining at least one combustion chamber and an output shaft arranged to drive a water propulsion device of said marine device, said engine having an intake system supplying air to said combustion chamber, said fuel supply system including at least one fuel injector for delivering fuel to said engine for combustion in said combustion chamber with said air, at least a first pump and a second pump positioned in said cowling arranged to deliver fuel from a fuel source to said at least one fuel injector, said first and second pumps each having an inlet, a main fuel line leading from said fuel source to a branch line extending to said inlet of each of said first and second pumps, said first pump positioned vertically higher than said second pump, said inlet of said second pump being positioned vertically lower than a point at which said branch lines extend from said main fuel line, a fuel filter positioned along said main fuel line through which said fuel passes and a pressure sensor provided at said filter along said main fuel line between said fuel source and said branch lines.

7. The fuel supply system in accordance with claim 4, wherein a fuel temperature sensor is provided for sensing the temperature of said fuel in said separator.

8. The fuel supply system in accordance with claim 1, wherein a respective branch line leads to a respective inlet of each of said pumps.

9. The fuel supply system in accordance with claim 1, wherein branch lines lead to the inlets of only two of said pumps and a further conduit extends from the outlet of one of said two pumps to the inlet of the remaining of said pumps.

10. The fuel supply system in accordance with claim 1, wherein said marine device comprises an outboard motor and said water propulsion device comprises a propeller.

11. The fuel supply system in accordance with claim 9 further including a vapor separator, said first, second and third pumps delivering fuel to said vapor separator.

12. The fuel supply system in accordance with claim 11, wherein a water jacket is provided about at least a portion of said vapor separator.

13. The fuel supply system in accordance with claim 11, wherein a first high pressure pump draws fuel from said vapor separator and delivers it to said at least one fuel injector.

14. The fuel supply system in accordance with claim 13, wherein said first high pressure pump delivers fuel to a second high pressure pump which delivers said fuel to said at least one fuel injector.

15. The fuel supply system in accordance with claim 11, wherein said first, second and third pumps are vertically arranged, said second pump being vertically below said first and third pumps.

16. The fuel supply system in accordance with claim 11, wherein said first, second and third pumps comprise low-pressure diaphragm type pumps.

17. The fuel supply system in accordance with claim 16, wherein said engine includes a crankcase and an air line extends between said crankcase and said first, second and third pumps whereby fluctuations in air pressure in said crankcase power said pumps.

* * * * *